US008485355B2

(12) United States Patent
England

(10) Patent No.: US 8,485,355 B2
(45) Date of Patent: Jul. 16, 2013

(54) PACK FOR SMOKING ARTICLES

(75) Inventor: John England, Mamaroneck, NY (US)

(73) Assignee: British American Tobacco (Investments) Limited, London (GB)

( * ) Notice: Subject to any disclaimer, the term of this patent is extended or adjusted under 35 U.S.C. 154(b) by 0 days.

(21) Appl. No.: 12/340,439

(22) Filed: Dec. 19, 2008

(65) Prior Publication Data

US 2009/0272660 A1 Nov. 5, 2009

Related U.S. Application Data

(63) Continuation of application No. 12/114,674, filed on May 2, 2008, now abandoned.

(51) Int. Cl.
*B65D 85/10* (2006.01)
*A24F 15/00* (2006.01)

(52) U.S. Cl.
USPC ..... 206/259; 206/273; 229/160.1; 493/58; 53/444

(58) Field of Classification Search
USPC ..... 206/268, 242, 273, 259, 271; 220/645, 220/674, 670, 669; 229/199, 919, 160.1, 229/87.13; D27/186; 53/444, 415, 461; 493/58, 493/162
See application file for complete search history.

(56) References Cited

U.S. PATENT DOCUMENTS

| | | | | | |
|---|---|---|---|---|---|
| 291,201 | A | | 1/1884 | Kinney | |
| 472,462 | A | * | 4/1892 | Mark | 229/89 |
| 960,922 | A | | 6/1910 | Hirschwitz et al. | |
| 1,548,237 | A | | 8/1925 | Ackermann | |
| 2,030,992 | A | | 2/1936 | Keller | |
| 2,078,665 | A | | 4/1937 | Horsley | |
| 2,333,416 | A | * | 11/1943 | Ducey | 206/256 |
| 2,547,005 | A | | 4/1951 | Herrick et al. | |
| 2,744,624 | A | | 5/1956 | Hoogstoel et al. | |
| 2,782,977 | A | | 2/1957 | Thompson | |
| 2,798,596 | A | | 7/1957 | Emmons | |
| 3,165,249 | A | | 1/1965 | Peck | |
| 3,203,617 | A | | 8/1965 | Paige | |
| 3,327,887 | A | | 6/1967 | Chalmers | |
| 3,732,663 | A | | 5/1973 | Geldmacher | |
| 4,059,220 | A | * | 11/1977 | Lorenz | 229/159 |
| 4,211,328 | A | * | 7/1980 | Petranyi | 206/525 |
| 5,073,162 | A | * | 12/1991 | Campbell et al. | 493/396 |

(Continued)

FOREIGN PATENT DOCUMENTS

| | | |
|---|---|---|
| DE | 10106547 A1 | 8/2002 |
| DE | 10106548 A1 | 8/2002 |

(Continued)

OTHER PUBLICATIONS

International Search Report and Written Opinion, mailed Jun. 2, 2009, for PCT/EP2009/053514, filed Mar. 25, 2009.

(Continued)

*Primary Examiner* — Steven A. Reynolds
(74) *Attorney, Agent, or Firm* — NW Poulsen

(57) ABSTRACT

A pack for smoking articles such as cigarettes having front and rear panels connected by opposite side panels, a bottom panel and a lid. At least one of the panels in the pack includes a plurality of transverse rigidifying bands. These bands are greater in thickness than a region between the bands. The bands may be formed by an embossing method.

18 Claims, 5 Drawing Sheets

U.S. PATENT DOCUMENTS

| | | | | | |
|---|---|---|---|---|---|
| 5,090,568 | A * | 2/1992 | Tse | 206/456 |
| 5,207,322 | A | 5/1993 | Focke et al. | |
| 5,277,315 | A * | 1/1994 | Plein | 206/270 |
| 5,366,077 | A | 11/1994 | Pham | |
| D356,183 | S | 3/1995 | Conti | |
| 5,478,011 | A | 12/1995 | Pham | |
| 5,487,468 | A | 1/1996 | Sheahan | |
| 5,590,513 | A | 1/1997 | Belvederi | |
| 5,595,300 | A * | 1/1997 | Paik et al. | 206/449 |
| 5,762,230 | A * | 6/1998 | Policappelli | 220/62.12 |
| 5,896,984 | A * | 4/1999 | Focke et al. | 206/268 |
| 5,904,244 | A * | 5/1999 | Focke et al. | 206/268 |
| 5,924,627 | A * | 7/1999 | Wilder et al. | 229/182.1 |
| 5,950,913 | A * | 9/1999 | Rea et al. | 229/120.32 |
| 5,964,345 | A * | 10/1999 | Gamberini | 206/259 |
| D418,940 | S | 1/2000 | Luton et al. | |
| D421,151 | S | 2/2000 | Luton et al. | |
| 6,186,394 | B1 * | 2/2001 | Dees et al. | 229/122.34 |
| D441,496 | S | 5/2001 | Focke et al. | |
| D441,497 | S | 5/2001 | Focke et al. | |
| 6,276,600 | B1 | 8/2001 | Rigby | |
| 6,302,322 | B1 | 10/2001 | Focke et al. | |
| 6,343,691 | B1 * | 2/2002 | Focke et al. | 206/268 |
| D454,410 | S | 3/2002 | Draghetti | |
| 6,364,106 | B1 | 4/2002 | Fagg et al. | |
| D463,066 | S | 9/2002 | Draghetti | |
| D472,013 | S | 3/2003 | Conti et al. | |
| 6,591,982 | B2 | 7/2003 | Focke et al. | |
| 6,592,023 | B2 | 7/2003 | Li Vigni et al. | |
| D479,357 | S | 9/2003 | Focke et al. | |
| D480,174 | S | 9/2003 | Draghetti et al. | |
| D487,532 | S | 3/2004 | Draghetti et al. | |
| 6,755,300 | B2 * | 6/2004 | Brizzi | 206/273 |
| D500,387 | S | 12/2004 | Draghetti et al. | |
| 6,941,728 | B1 | 9/2005 | Bray et al. | |
| 6,974,027 | B2 | 12/2005 | Boriani et al. | |
| 7,025,201 | B2 * | 4/2006 | Draghetti et al. | 206/268 |
| 7,044,294 | B2 | 5/2006 | Lutzig | |
| 7,229,681 | B2 | 6/2007 | Boegli | |
| 7,438,182 | B2 | 10/2008 | Gamberi et al. | |
| 7,455,176 | B2 | 11/2008 | Focke et al. | |
| 7,506,755 | B2 | 3/2009 | Buse et al. | |
| 7,562,772 | B2 | 7/2009 | Lutzig | |
| D613,903 | S | 4/2010 | Wu et al. | |
| D636,931 | S | 4/2011 | de The et al. | |
| D636,932 | S * | 4/2011 | de The et al. | D27/189 |
| 2002/0070220 | A1 | 6/2002 | Kuehn et al. | |
| 2002/0179464 | A1 * | 12/2002 | Focke et al. | 206/259 |
| 2004/0256254 | A1 * | 12/2004 | Draghetti et al. | 206/259 |
| 2005/0000128 | A1 * | 1/2005 | Chen | 40/454 |
| 2005/0121340 | A1 * | 6/2005 | Spatafora | 206/259 |
| 2005/0224375 | A1 | 10/2005 | Focke et al. | |
| 2006/0000882 | A1 * | 1/2006 | Darzinskas | 229/403 |
| 2006/0191986 | A1 | 8/2006 | Focke et al. | |
| 2006/0266807 | A1 * | 11/2006 | Shook | 229/67.3 |
| 2006/0283732 | A1 * | 12/2006 | Lutzig | 206/259 |
| 2010/0072268 | A1 * | 3/2010 | Johnson et al. | 229/403 |
| 2011/0192737 | A1 | 8/2011 | Ancona et al. | |
| 2011/0240494 | A1 | 10/2011 | Vecchi | |

FOREIGN PATENT DOCUMENTS

| | | | |
|---|---|---|---|
| DE | 10106549 | A1 | 8/2002 |
| EM | 000014543-0002 | | 7/2003 |
| EM | 000014543-0008 | | 7/2003 |
| EM | 000014543-0009 | | 7/2003 |
| EM | 000014543-0011 | | 7/2003 |
| EM | 000014543-0025 | | 7/2003 |
| EM | 000014543-0035 | | 7/2003 |
| EM | 000014543-0036 | | 7/2003 |
| EM | 000014543-0037 | | 7/2003 |
| EM | 000014543-0038 | | 7/2003 |
| EM | 000014543-0039 | | 7/2003 |
| EM | 000014543-0041 | | 7/2003 |
| EM | 000014543-0042 | | 7/2003 |
| EM | 000014543-0043 | | 7/2003 |
| EM | 000014543-0044 | | 7/2003 |
| EM | 000168273-0002 | | 7/2004 |
| EM | 000168273-0003 | | 7/2004 |
| EM | 000682018-0002 | | 3/2007 |
| EM | 000682018-0016 | | 3/2007 |
| EM | 000682018-0019 | | 3/2007 |
| EM | 000893235-0001 | | 4/2008 |
| EP | 0303865 | A2 | 2/1989 |
| EP | 0584431 | A1 | 3/1994 |
| EP | 1184300 | A1 | 3/2002 |
| JP | 1080037 | S | 7/2000 |
| JP | 1171597 | S | 4/2003 |
| JP | 2007-256347 | A | 10/2007 |
| TW | 418041 | S | 1/2001 |
| TW | D119598 | S | 10/2007 |
| WO | 94/19245 | A1 | 9/1994 |
| WO | 02/40379 | A1 | 5/2002 |
| WO | 02/49835 | A1 | 6/2002 |
| WO | 02/49940 | A1 | 6/2002 |
| WO | 02/064450 | A1 | 8/2002 |
| WO | 02/064451 | A1 | 8/2002 |
| WO | 02/064452 | A1 | 8/2002 |
| WO | 03/033378 | A1 | 4/2003 |
| WO | 03/053795 | A2 | 7/2003 |
| WO | 2004/080844 | A1 | 9/2004 |
| WO | 2006/012960 | A1 | 2/2006 |

OTHER PUBLICATIONS

International Preliminary Report On Patentability, completed Jul. 15, 2010, for International Application No. PCT/EP2009/053514, filed Mar. 25, 2009.

* cited by examiner

PACK FOR SMOKING ARTICLES

CLAIM FOR PRIORITY

This application claim priority under 35 USC §120 and is a Continuation of currently pending U.S. application Ser. No. 12/114,674, filed May 2, 2008, now abandoned titled "A Pack for Smoking Articles". The entire contents of the aforementioned application is herein expressly incorporated by reference.

This invention relates to a pack for smoking articles, particularly but not exclusively cigarettes.

It is well known to fabricate packs for smoking articles such as cigarettes from a blank of board, for example cardboard, that comprises front and rear panels connected by opposite side panels, a bottom panel and a lid. The lid may be configured in a so called flip-top arrangement.

A problem with such conventional packs is that the panels particularly the front and rear panels, may bow undesirably, especially when the grain of the board runs parallel to the length of the pack. It would be desirable to use thinner board for fabricating the packs in order to save cost but the use of thinner board can feel flimsy to the user and also the thinner board limits the options for pack shapes because the thinner board is too weak for wide packs.

It is known to provide an inner frame in a conventional flip-top pack to provide a jam against which the lid can abut in the closed position with its exterior periphery coextensive with the remainder of the pack. It has been proposed in U.S. Pat. No. 5,964,345 to provide ribbing on the surface of the inner frame that abuts the interior surface of the front panel of the pack. However, this configuration undesirably uses up space within the container and adds to the overall material cost of the pack.

According to the invention, there is provided a pack for smoking articles comprising front and rear panels connected by opposite side panels a bottom panel and a top panel, wherein at least one of the panels includes a plurality of transverse bands greater in thickness than a region between the bands.

The top panel may comprise a lid. The bands can be formed on the exterior periphery of the pack and both the front and rear panels may include the transverse bands.

Conveniently, the bands may be embossed either during manufacture of the blank or as a pre-production step in the process of packing smoking articles into the pack.

The pack may be fabricated from sheet material and the bands may comprise corrugations formed in the thickness of the sheet material. At least one of the corrugations may be formed on the lid.

The invention also includes a blank for fabricating a pack for smoking articles comprising front and rear panel portions, a bottom panel portion and side panel portions and a portion to form a lid, in which at least one of the panel portions includes a plurality of transverse bands greater in thickness than a region between the bands.

The invention further includes a method of fabricating a pack for smoking articles, blank comprising front and rear panel portions, a bottom panel portion and side panel portions and a portion to form a lid, the method comprising forming in at least one of the panel portions a plurality of transverse bands greater in thickness than the region between the bands.

The method may include embossing the blank to form the transverse bands.

The method may be performed by feeding successive ones of the blank from a magazine thereof to an embossing station to form the bands, and feeding the embossed blanks to a smoking article packaging machine to be formed into packs filled with smoking articles.

As used herein, the term "smoking article" includes smokeable products such as cigarettes, cigars and cigarillos whether based on tobacco, tobacco derivatives, expanded tobacco, reconstituted tobacco or tobacco substitutes and also heat not-burn products. The smoking article may be provided with a filter for the gaseous flow drawn by the smoker.

In order that the invention may be more fully understood, an embodiment thereof will now be described by way of illustrative example with reference to the accompanying drawings in which.

Figure 8:
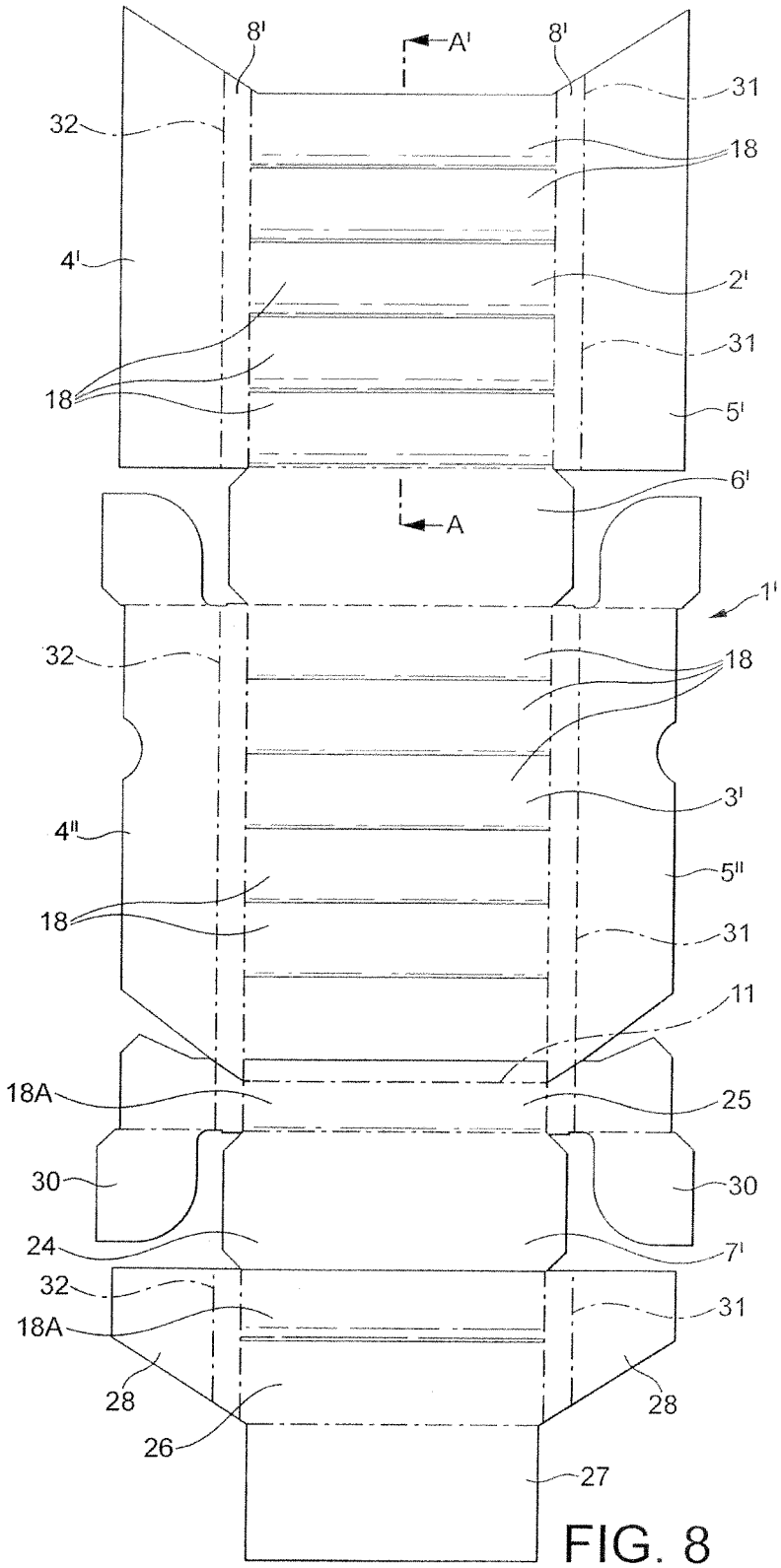
FIG. 8 is a schematic illustration of a blank used for fabricating the pack shown in FIGS. 1 to 7.

Referring to FIGS. 1 to 8, a flip-top pack 1 for cigarettes is formed from a blank shown in FIG. 8 and comprises front panel 2, rear panel 3, side panels 4, 5, a bottom panel 6 and a hinged lid 7, all formed by folding and gluing selected portions of the blank shown in FIG. 8, formed of board stock sheet material such as cardboard.

The pack has longitudinally extending bevelled edge portions 8 along the joins between the side panels 4, 5 and the front and rear panels 2, 3.

Figure 1:
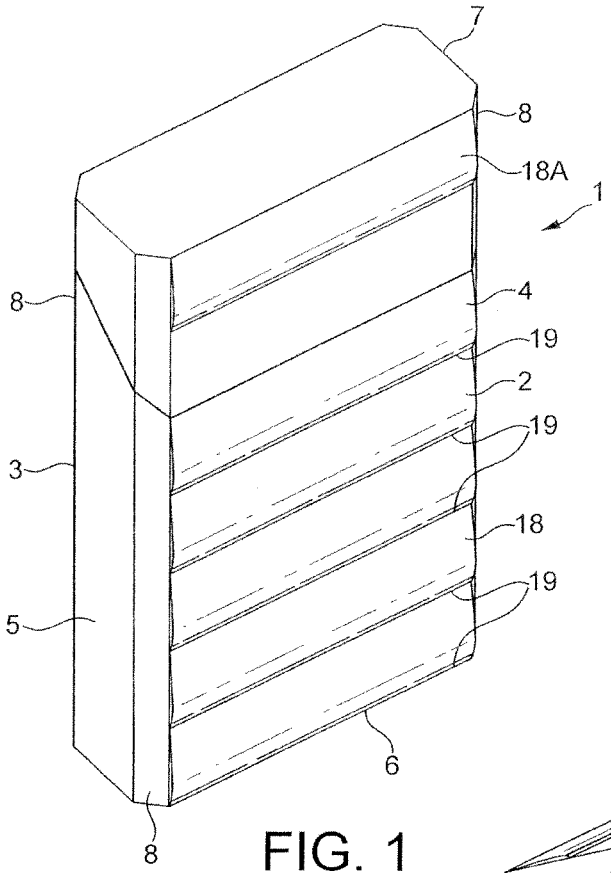
FIG. 1 is a schematic perspective view of a cigarette pack from the front and one side with its lid closed.
Figure 2:
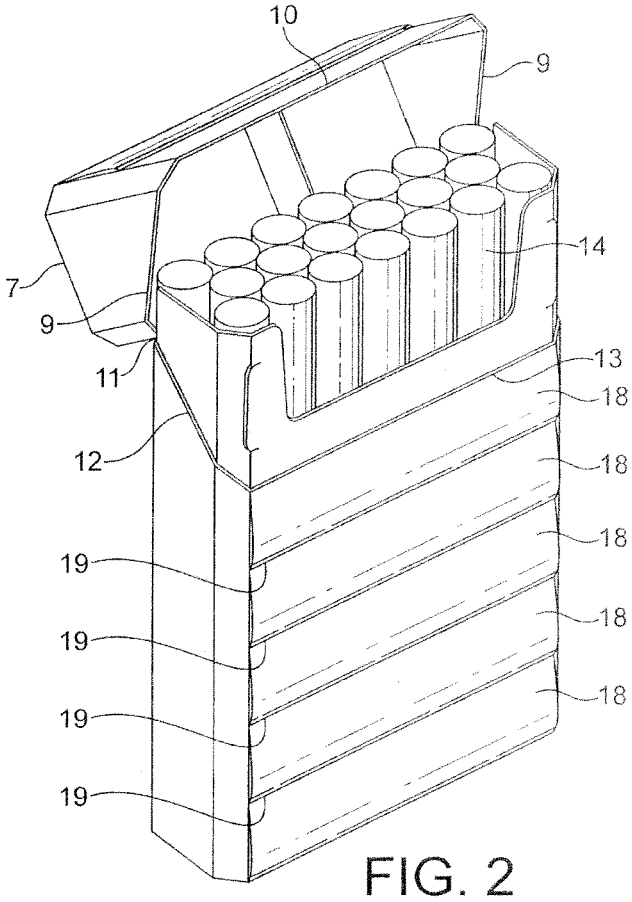
FIG. 2 illustrates the pack of FIG. 1 with the lid open.
Figure 3:
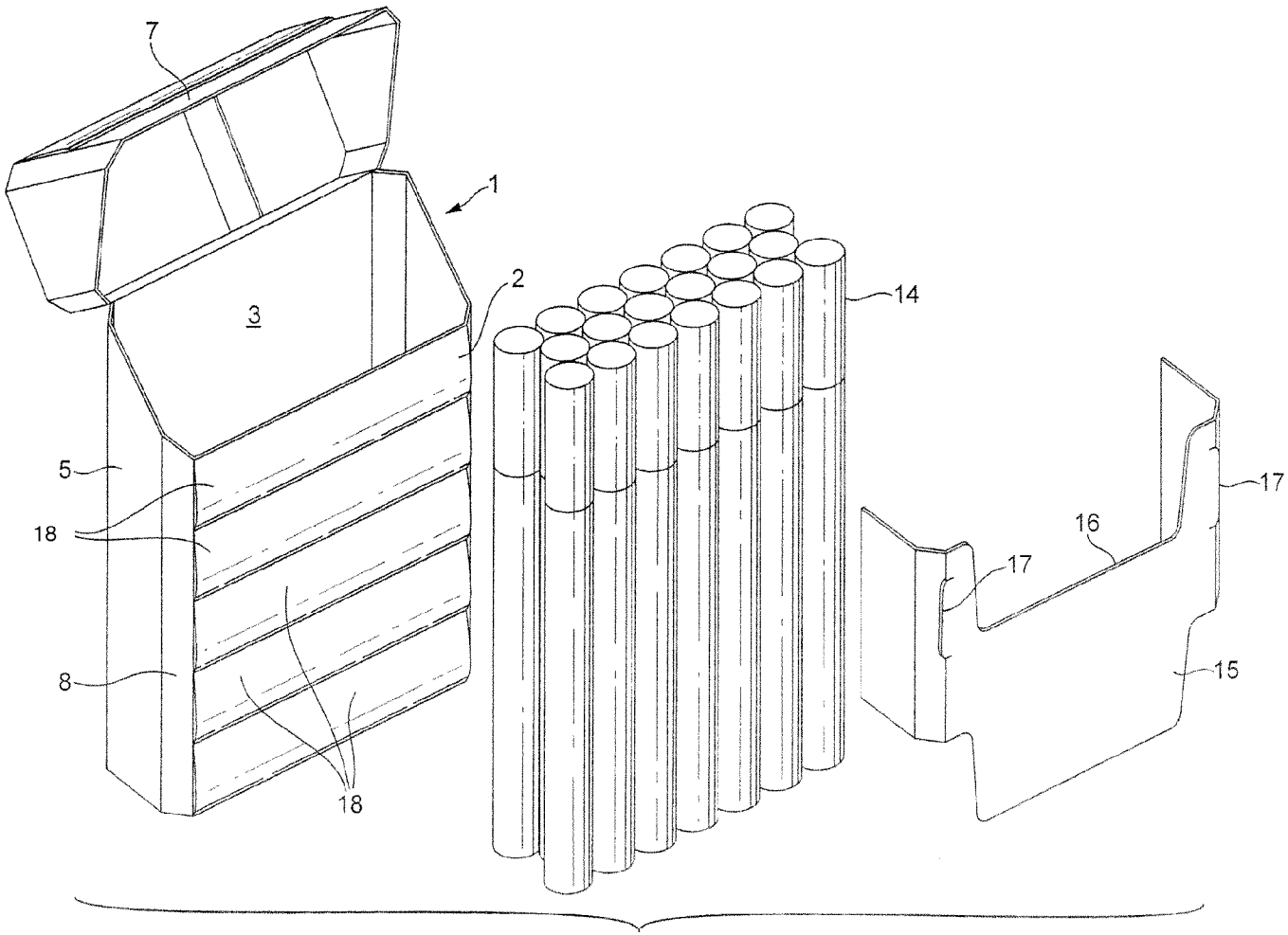
FIG. 3 is a schematic, exploded view of the pack shown in FIGS. 1 and 2.

The lid 7 has sloping side edges 9 and a front edge 10 which in a closed position is lower than hinge line 11 for the lid, and the upper edges 12, 13 of the front and side panels 2, 3, 4 are correspondingly shaped to provide a close fit when the lid is shut. As shown in FIGS. 2 and 3, the pack contains twenty cigarettes 14 in this example and as well known in the art, the sloping arrangement of the lid 7 provides improved access to the cigarettes when the lid is opened.

An inner frame 15 of board stock sheet material such as cardboard is fitted within the upper part of the opening of the container e.g. by gluing and includes a re-entrant part 16 to provide user access to the cigarettes. The inner frame 15 is of a shape to bound the interior of the front and side panels 2, 3, 4 along with the bevelled edges 8 adjacent the front panel so as to act as a jam against which the lid 7 can abut when closed, with its exterior surface co-extensive with the front and side panels 2, 4, 5. The inner frame 15 includes depending flanges 17 which act as stops to hold the lid 7 when closed.

The front and rear panels 2, 3 are provided with transverse bands 18 that may be formed by embossing the blank as will be explained in more detail later.

Figure 9:
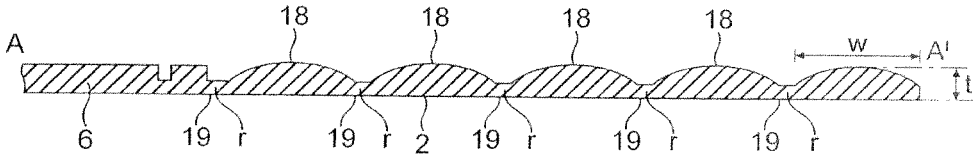
FIG. 9 is a partial sectional view taken along the line A-A' in FIG. 8

The transverse bands 18 comprise corrugations illustrated in FIG. 9. The bands 18 have a thickness t which is greater than the thickness r of regions 19 between the bands 18. The regions 19 may be formed by embossing although other techniques can be used for example to compress the board material along the regions 19 e.g. by scoring or swiping with a blunt blade.

Figure 4:
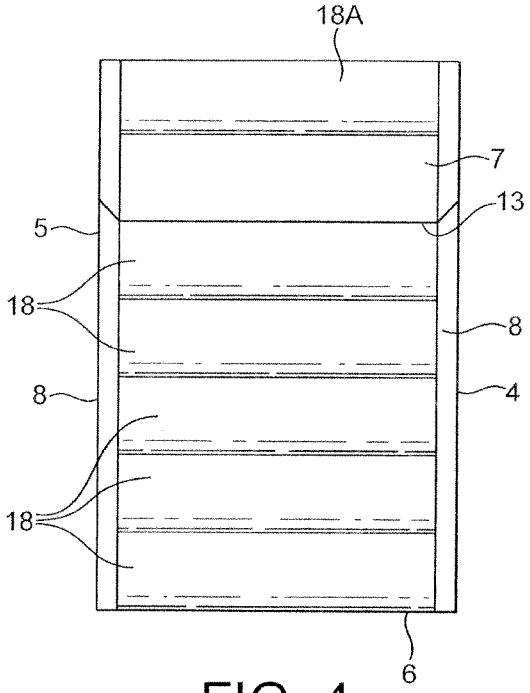
FIG. 4 is a front view of the pack.
Figure 5:
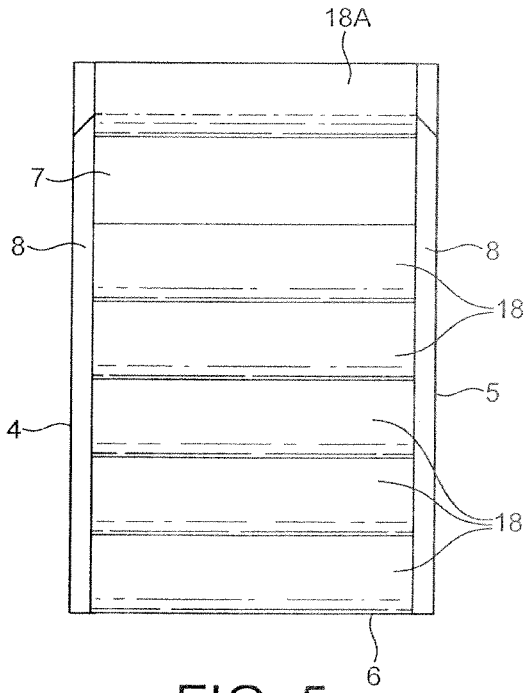
FIG. 5 is a rear view of the pack.
Figure 6:
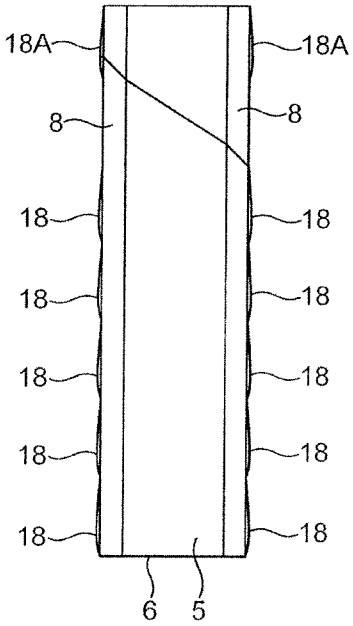
FIG. 6 is a side view of the pack.
Figure 7:
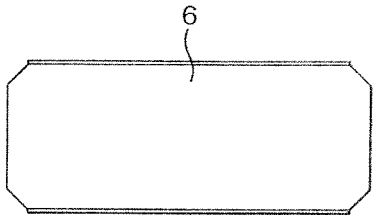
FIG. 7 is a bottom view of the pack.

In the described example, the corrugations 18 extend across the entire width of the front and rear panels 2, 3 and are of equal width w as shown in FIG. 9. The regions 19 between the corrugations 18 are in this example rectilinear and parallel to one another. Further such corrugations 18A are provided on the front and rear of the lid 7 as shown in FIGS. 4 and 5.

The corrugations 18 have the effect of rigidifying and strengthening the front and rear panels 2, 3 of the pack, with the result that a thinner board stock material can be used for forming the blank without loss of rigidity of the assembled pack. This results in reduced cost not only in terms of the material used but also in terms of transport costs as a result of the reduced pack weight. The corrugations 18A perform a similar function for the lid 7.

Also, the rigidification provided by the corrugations 18 make the pack less susceptible to the direction of grain of the board stock which can be arranged either longitudinally or transversely of the pack without any significant change in rigidity in the front and rear panels 2, 3.

In addition, by using the described corrugations 18, the pack can be made wider than hitherto for a particular board thickness, thereby giving the designer freedom to devise new packaging designs.

Furthermore, the corrugations 18, 18A provide a tactile gripping surface on the exterior of the pack which assists the user in gripping the pack and opening the lid 7.

The card used in the pack 1 may have a weight of 180-300 g/squ.m, for example 280 g/squ.m, but with the provision of the bands 18, a lighter material may be used for example 215 g/squ.m. or even 200 g/squ.m. The lighter the weight, the less rigid the card, but this is ameliorated by the provision of the bands 18. The card is typically of the order of 0.3 mm thick and the depth of the embossing that forms the bands 18 be of the order of 50% of the un-bossed card thickness.

Figure 10:
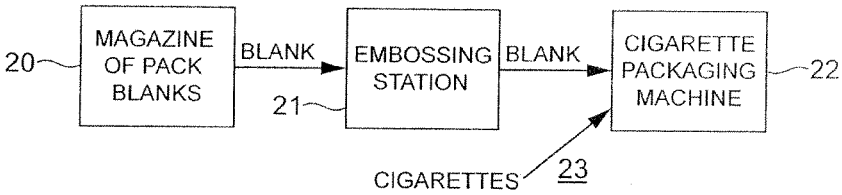
FIG. 10 is schematic illustration of a facility for packaging cigarettes in a pack as shown in FIGS. 1 to 7.
Figure 11:
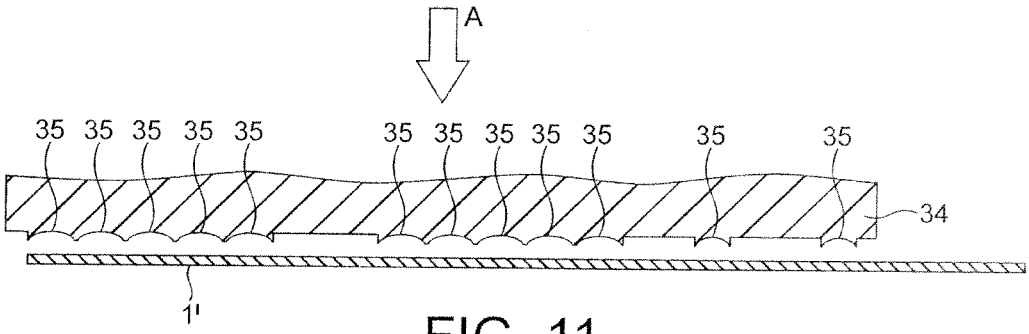
FIG. 11 is a schematic illustration of an embossing station for use in the facility shown in FIG. 10.

A method of packaging cigarettes in the pack will now be described with reference to FIGS. 10 and 11. A magazine 20 as shown in FIG. 10 contains a plurality of blanks 1' substantially as illustrated in FIG. 8 but without the corrugations 18. The blanks may be pre-printed and pre-formed with lines of folding in a manner well known in the art. Individual blanks are conveyed sequentially to an embossing station 21 at which the corrugations 18 are embossed onto the pre-printed blank. Thereafter, the blanks are fed to a cigarette packaging machine 22 that is fed with a supply of cigarettes 23. The cigarette packaging machine 22 folds the blank so as to form the pack 1 and fills it with cigarettes that may be provided on the inner frame 15 and wrapped in foil (not shown).

In order to form the pack, the packaging machine 22 operates in a manner known to those in the art, so as to fold blank shown in FIG. 8 along the hatched fold lines in order to create the pack. The blank 1' comprises a front panel portion 2' and a rear panel portion 3' that are connected by a base panel portion 6'. The lid is formed of a lid panel portion 7' that has a lid top 24, a lid rear panel 25, lid front panel 26 and re-entrant flaps 27/30 which can be folded inwardly to create the lid structure shown in FIGS. 1-3.

The side walls 4, 5 of the pack are formed from panel portions 4', 4", 5', 5" that depend from the front and rear panel portions 2', 3' respectively. When the pack is folded, the panel portions 4', 4" and 5, 5" overlie one another and are glued together to form the side panels 4, 5.

The bevelled edges 8 are created from regions 8' by folding along hatched fold lines 31, 32. When assembled, the lid 7 can hinge along hinge line 11.

Initially, the blank may be pre-printed with trading and user information but is without the corrugations 18, 18*a*. They are applied subsequently at the embossing station 21, which may utilise an embossing tool as illustrated in FIG. 11. Here, the pre-printed blank 1' is placed in alignment with an embossing tool 34 shown in section which is moved in the direction at arrow A in order to emboss the surface of the blank. The tool 34 includes a series of concave corrugations 35 that are a mirror of the eventual convex corrugations 18 formed in the blank which, when driven downwardly onto the blank 1' embosses the corrugations into the blank to achieve the configuration shown in FIG. 8.

Thereafter, the embossed blank 1' is fed to the cigarette packaging machine 22 shown in FIG. 10 for assembly and filling as previously described.

Many modifications and variations of the described pack fall within the scope of the invention. Whilst the same number of corrugations 18 are shown on the front and rear panels 2, 3 of the pack, different numbers could be used, for example fewer corrugations 18 could be provided on the rear panel 3 as compared with the front panel. Also, not all of the front panel need be provided with the corrugations 18 and part of the panel surface may be provided in a planar configuration without corrugations.

Furthermore, whilst the described pack has bevelled edges 8, they can be omitted such that the pack either has rectangular edges or curved edges. When curved edges are provided, the corrugations 18 have the advantage of permitting a relatively thin board material to be used which can readily be deformed into a curved edge whilst providing the front and rear surfaces of the pack with rigidification.

The corrugations 18 do not need to be of the same width as described above and can be of varying widths. Furthermore, the corrugations do not need to be rectilinear and may have curved edges. The corrugations 18 do not need to extend across the entire width of the front and rear panels 2, 3.

Also, the embossing tool for the embossing station 21 could be a rotary embossing device and other ways of creating the bands or corrugations will be apparent to those skilled in the art, which do not necessarily involve embossing.

Also the blanks may be pre-formed with the bands 18 at the time of manufacture so that the blanks held in the magazine 20 already have the bands, which avoiding the need for the embossing station 21.

Whilst the invention has been described in relation to a flip-top pack it can be used in connection with other packs for smoking articles which do not necessarily have a lid, for example a container that holds a plurality of flip-top cigarette packs.

Many other modifications and variations will be evident that fall within the scope of the following claims.

The invention claimed is:

1. A pack for smoking articles, comprising:

front and rear panels, opposite side panels, a bottom panel and a top panel, the panels being connected in edge regions thereof, wherein the pack is fabricated from board stock material, and wherein at least one of the panels includes compressed board stock corrugations on an exterior surface, the corrugations comprising a plurality of transverse bands greater in width and thickness than a region between the bands, the bands extending continuously across said at least one panel.

2. The pack according to claim 1 wherein the top panel comprises a lid.

3. The pack according to claim 1 wherein both the front and rear panels include said transverse bands on the exterior surface thereof.

4. The pack according to claim 1 wherein the bands are embossed.

5. The pack according to claim 4 including at least one of the corrugations on the top panel.

6. The pack according to claim 5 wherein the corrugations have generally parallel side edges.

7. The pack according to claim 1, wherein the board stock material comprises cardboard.

8. The pack according to claim 1 containing smoking articles.

9. The pack according to claim 8 wherein the smoking articles comprise cigarettes.

10. The pack according to claim 2 wherein the lid comprises a flip top.

11. The pack according to claim 1 including an inner frame within the pack.

12. The pack according to claim 1 wherein corner edges thereof are bevelled, curved or rectangular.

13. A blank for fabricating a pack for smoking articles, comprising:

front and rear panel portions, a bottom panel portion, side panel portions and a portion to form a lid, wherein the blank is of board stock material, and wherein at least one of the panel portions includes compressed board stock corrugations disposed on an exterior surface when assembled into the pack, the corrugations comprising a plurality of transverse bands greater in width and thickness than a region between the bands, the bands extending continuously across said at least one panel portion.

14. A method of fabricating a pack for smoking articles from a blank of board stock material comprising:

forming a pack comprising front and rear panel portions, a bottom panel portion, side panel portions and a portion to form a lid; and forming in at least one of the panel portions compressed board stock corrugations that are disposed on an exterior surface thereof when assembled into the pack, the corrugations comprising a plurality of transverse bands greater in width and thickness than a region between the bands, the bands extending continuously across said at least one panel portion.

15. The method according to claim 14 including embossing the blank to form the transverse bands.

16. The method according to claim 15 including feeding successive ones of the blank from a magazine thereof to an embossing station to form said bands, and feeding the embossed blanks to a cigarette packaging machine to be formed into packs filled with cigarettes.

17. The method of claim 14, wherein the corrugations are convex.

18. The method of claim 14, wherein the traverse bands are formed in at least one of the front and rear panel portions and extend between the side panel portions.

* * * * *